US010603863B2

(12) United States Patent
Oliver et al.

(10) Patent No.: US 10,603,863 B2
(45) Date of Patent: Mar. 31, 2020

(54) SYSTEM AND METHOD FOR EXPANDING FLAT-STOCK PRECURSOR MATERIAL

(71) Applicant: FoldedPak, Inc., Denver, CO (US)

(72) Inventors: William H. Oliver, Denver, CO (US); Robert C. Saverino, Denver, CO (US)

(73) Assignee: FoldedPak, Inc., Denver, CO (US)

( * ) Notice: Subject to any disclaimer, the term of this patent is extended or adjusted under 35 U.S.C. 154(b) by 765 days.

(21) Appl. No.: 14/790,373

(22) Filed: Jul. 2, 2015

(65) Prior Publication Data

US 2016/0001518 A1 Jan. 7, 2016

Related U.S. Application Data

(60) Provisional application No. 62/020,821, filed on Jul. 3, 2014.

(51) Int. Cl.
*B31D 5/00* (2017.01)

(52) U.S. Cl.
CPC ..... *B31D 5/006* (2013.01); *B31D 2205/0041* (2013.01); *B31D 2205/0058* (2013.01); *B31D 2205/0064* (2013.01)

(58) Field of Classification Search
None
See application file for complete search history.

(56) References Cited

U.S. PATENT DOCUMENTS 4,270,744 A 6/1981 Trogan
5,078,374 A 1/1992 Odeau
5,254,389 A * 10/1993 Tether ..... B31D 5/006 206/584
5,429,578 A 7/1995 Calbrix et al.
5,846,177 A 12/1998 Mayr
6,835,437 B2 12/2004 Goers et al.
2002/0064625 A1* 5/2002 Goers ..... B65D 5/5035 428/131
2003/0121426 A1 7/2003 Nanba et al.
2003/0130103 A1* 7/2003 Fujinuma ..... B65H 45/163 493/432
2004/0084826 A1* 5/2004 Kostiza ..... B65H 45/164 270/50
2004/0235633 A1* 11/2004 De Matteis ..... B65H 45/20 493/424
2006/0014617 A1* 1/2006 Leupold ..... B65H 45/166 493/424
2007/0042888 A1* 2/2007 Prum ..... B65H 45/162 493/432
2009/0203510 A1* 8/2009 Kurihara ..... B65H 45/162 493/434

(Continued)

OTHER PUBLICATIONS

PCT International Search Report and Written Opinion in International Application PCT/US2015/039024, dated Sep. 24, 2015, 14 pgs.

*Primary Examiner* — Michelle Lopez
*Assistant Examiner* — Chinyere J Rushing-Tucker

(57) ABSTRACT

A base has an end plate adapted to rotate about an axis substantially orthogonal to the base. A first jaw extends from the end plate and is pivotably engaged with the end plate. As the end plate rotates about the axis, the first jaw defines a first separation angle when the end plate is at a first position and the first jaw defines a second separation angle when the end plate is at a second position.

10 Claims, 21 Drawing Sheets

(56) References Cited

U.S. PATENT DOCUMENTS

| | | | | |
|---|---|---|---|---|
| 2011/0237415 | A1* | 9/2011 | Kojima | B65H 45/168 493/442 |
| 2013/0071605 | A1 | 3/2013 | Boothman | |
| 2013/0071613 | A1* | 3/2013 | Boothman | B32B 3/06 428/131 |
| 2017/0008654 | A1* | 1/2017 | Boothman | B65B 55/20 |

* cited by examiner

SYSTEM AND METHOD FOR EXPANDING FLAT-STOCK PRECURSOR MATERIAL

CROSS REFERENCE TO RELATED APPLICATIONS

This application claims priority to and the benefit of U.S. Provisional Patent Application Ser. No. 62/020,821, filed Jul. 3, 2014, and entitled "System and Method for Expanding Flat-Stock Packing Material," the disclosure of which is hereby incorporated by reference herein in its entirety.

INTRODUCTION

Paper packing elements are used to protect items during shipment from any company or individual packing an item inside of a box, for example, on-line retailers or manufacturers to consumers or third-party retailers or individuals shipping packages via a parcel system. Paper packing elements are often desirable over non-paper based products such as expanded foam (commonly referred to as "foam in place"), pre-formed packing materials (commonly referred to as "packing peanuts"), or air-filled plastic bladders (referred to as "bubble wrap" or "air bags") for a number of reasons. A first reason is that paper materials are non-petroleum based products and are viewed to be more environmentally friendly as they are formable from recycled materials and/or recyclable after use. Another reason is that, prior to being used as packing materials, the flat-stock paper precursors used to make the packing elements may be stored flat, taking up less space in a facility. Other reasons are or would be known to a person of skill in the art. Various types of paper packing elements are disclosed in U.S. Pat. No. 6,835,437; and U.S. Patent Application Publication Nos. 2013/0071605 and 2013/0071613, the disclosures of which are hereby incorporated by reference herein in their entireties.

SUMMARY

In one aspect, the technology relates to a system having: a base; an end plate rotatably engaged with the base, wherein the end plate is adapted to rotate about an axis substantially orthogonal to the base; and a first jaw extending from the end plate, therein the first jaw is pivotably engaged with the end plate, wherein as the end plate rotates about the axis, the first jaw defines a first separation angle when the end plate is at a first position and the first jaw defines a second separation angle when the end plate is at a second position. In an embodiment, a second jaw is disposed opposite the axis from the first jaw. In another embodiment, the first jaw has a first pivotable clamp, a fixed base portion, and a second pivotable clamp disposed opposite the fixed base portion from the first pivotable clamp. In yet another embodiment, the base defines a cam, and wherein the system further includes: a follower disposed in the groove cam; and a lever connected to the follower, wherein movement of the lever changes a separation angle of the first jaw. In still another embodiment, the system includes a master gear engaged with the lever; at least one slave gear rotatably engaged with the master gear, wherein the at least one slave gear is engaged with at least a portion of the first jaw, such that a rotation of the master gear pivots the at least one portion of the first jaw. In another embodiment, the first pivotable clamp has a pin, and wherein when the first jaw is at the first separation angle, the pin extends above a surface of the base portion, and wherein when the first jaw is at the second separation angle, the pin is retracted below the surface of the base portion.

In another aspect, the technology relates to a method of folding a sheet of stock into a folded packing material, the method including: capturing the sheet of stock when the sheet of stock is in a substantially flat orientation; rotating the sheet of stock about an axis; and simultaneously while rotating the sheet of stock about the axis, folding the sheet of stock into a substantially folded configuration. In an embodiment, the sheet of stock includes a plurality of parallel precursor chips, and wherein the method further includes separating the parallel precursor chips into discrete precursor chips. In another embodiment, the sheet of stock includes a plurality of rows of precursor chips, wherein the capturing operation is performed on a second row of precursor chips at substantially the same time as the rotating operation is performed on a first row of precursor chips. In yet another embodiment, the method further includes separating the first row of precursor chips from the second row of precursor chips. In still another embodiment, the method further includes locking each of the plurality of parallel precursor chips in the folded configuration.

In another aspect, the technology relates to a method including rotating a sheet of stock about an axis while simultaneously folding the sheet of stock from a substantially flat configuration to a folded configuration. In an embodiment, the sheet of stock has a first row of precursor chips and a second row of precursor chips, the method further including: while rotating the sheet of stock about the axis, separating the first row of precursor chips from the second row of precursor chips. In another embodiment, each of the first row of precursor chips and the second row of precursor chips includes a plurality of precursor chips, the method further including: while rotating the sheet of stock about the axis, separating each of the plurality of precursor chips in the first row of precursor chips. In yet another embodiment, the method further includes removing a folded portion of the sheet of stock from a folding machine.

In another aspect, the technology relates to a system including: a base; a movable element movable relative to the base; and a leading jaw including: a leading base portion fixed relative to the movable element; and a leading pair of clamps pivotable relative to the moveable element. In an embodiment, the leading jaw includes a plurality of substantially parallel leading jaws, wherein each leading pair of clamps of the substantially parallel leading jaws are configured to pivot simultaneously. In another embodiment, the system further includes a following jaw parallel to the leading jaw, wherein the following jaw includes: a following base portion fixed relative to the movable element; and a following pair of clamps pivotable relative to the moveable element. In yet another embodiment, the following pair of clamps of the following jaw pivot about axes substantially parallel to axes defined by each of the leading pair of clamps of the leading jaw. In still another embodiment, the movable element is a rotating plate having an axis of rotation and wherein the leading jaw and the following jaw are disposed on opposite sides of the axis of rotation.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1A:
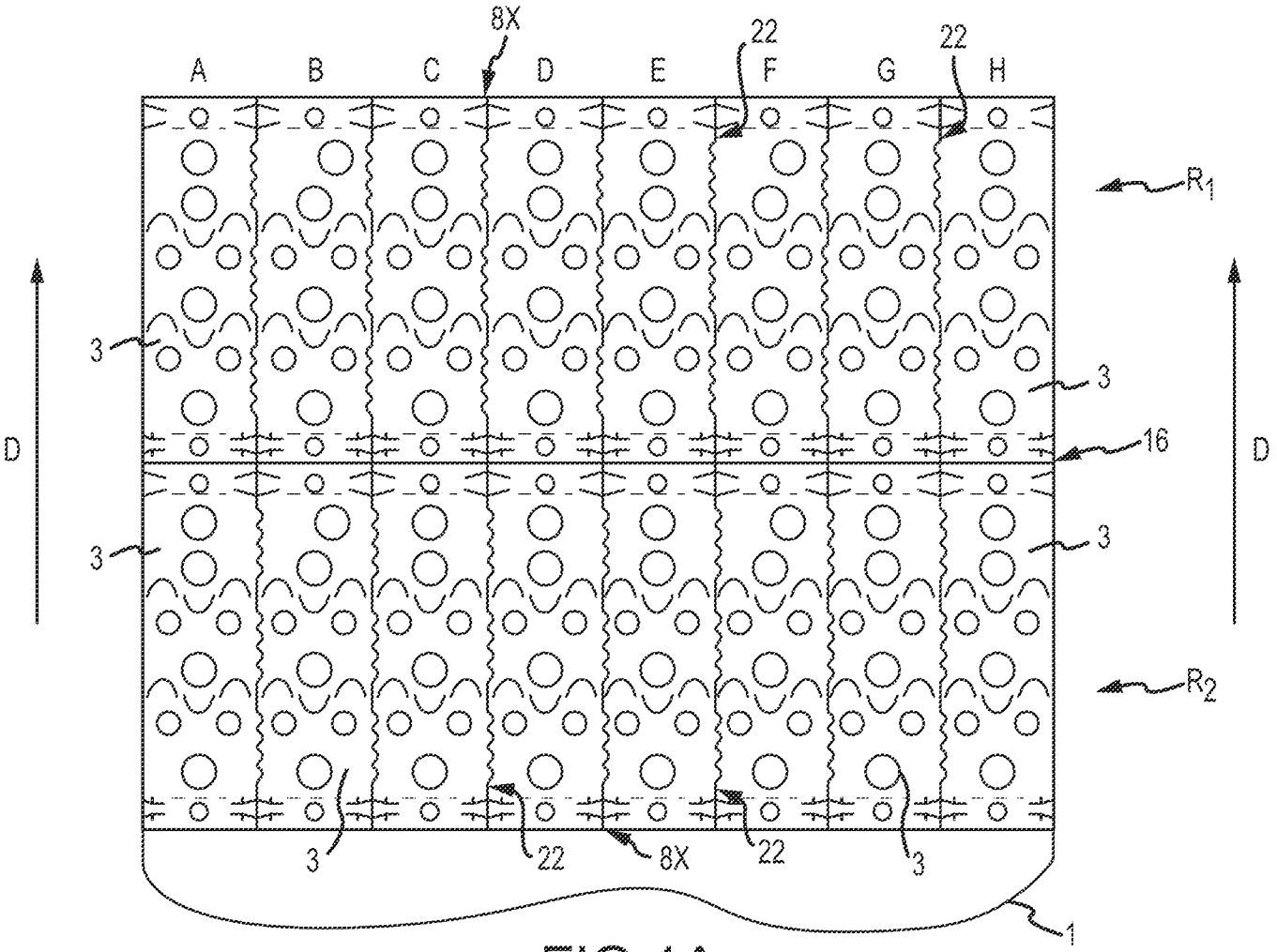
FIG. 1A depicts a sheet of flat stock paper precursor material.

FIG. 1A depicts a flat-stock paper precursor material sheet 1 that can be processed by the machines depicted herein into a plurality of expanded packing elements. As illustrated in FIG. 1A, the sheet 1 includes eight columns A-H of individual precursor chip 3. Only two rows $R_1$, $R_2$ are depicted, but on a continuous sheet 1, any number of rows may be present. Similarly, the total number of columns may be greater or fewer than eight. One commercial embodiment includes up to 15 columns, although sheets having a greater number of columns also are contemplated. Regardless of the number of rows or columns, it is desirable that the precursor chip 3 formed on the sheet 1 remain attached to one another as they are loaded on the machine, until separated at certain stages of processing. This delay of the separation process allows for R2 to be pulled into the machine via R1 prior to the separation of R1 and R2.

The sheet 1 includes a perforation line 8X between adjacent precursor chip 3 to enable them to be completely separated from one another during processing. The separation between adjacent chips 3 in a single row is accomplished, for example, by bursting or cutting connecting tabs 22 at the chip interfaces. As illustrated in FIG. 1A, lines 8X are zigzag in configuration, so that the edges formed on the separated and expanded packing elements will be jagged or serrated, thereby providing appropriate irregular surfaces for interlocking with other fully expanded packing elements when used as packaging. The lines 8X could be formed in other configurations that would accomplish the same result. The sheet 1 includes a line of weakness 16 between the precursor chip 3 in adjacent rows $R_1$, $R_2$. A precursor chip 3 in one row $R_1$ may be separated from an adjacent precursor chip in the same row $R_1$ by bursting the line of weakness 16. Other features (e.g., holes, apertures, etc.) are described in the above-referenced patents and publications. Each precursor chip 3 also includes tabs 11A, 11B to form connecting features to mechanically hold a fully-expanded packing element in shape. These connecting features may include: dovetail slots and grooves, tongue and groove cuts, hook cuts, and combinations thereof. These features are folded together to secure the sections of the precursor chip and thereby maintain the packing elements in their expanded form.

In the description of the various machines below, sheets 1 are fed onto a drum as that drum rotates. As used herein, the sheets are fed in a direction D onto the machine. As such, row $R_1$ is first loaded onto the machine and, as the drum advances, row $R_2$ is next pulled onto the machine by R1 prior to R1 being mechanically separated from R2. In a continuous sheet 1, a third row (and subsequent rows) is loaded and processed (e.g., "folded" or "expanded"). In this example, row $R_1$ is referred to as the leading row, while row $R_2$ is referred to as the following row. Similarly, row $R_2$ would be a leading row while a third row would be referred to as a following row. Such nomenclature is used herein for clarity.

Figure 1B:
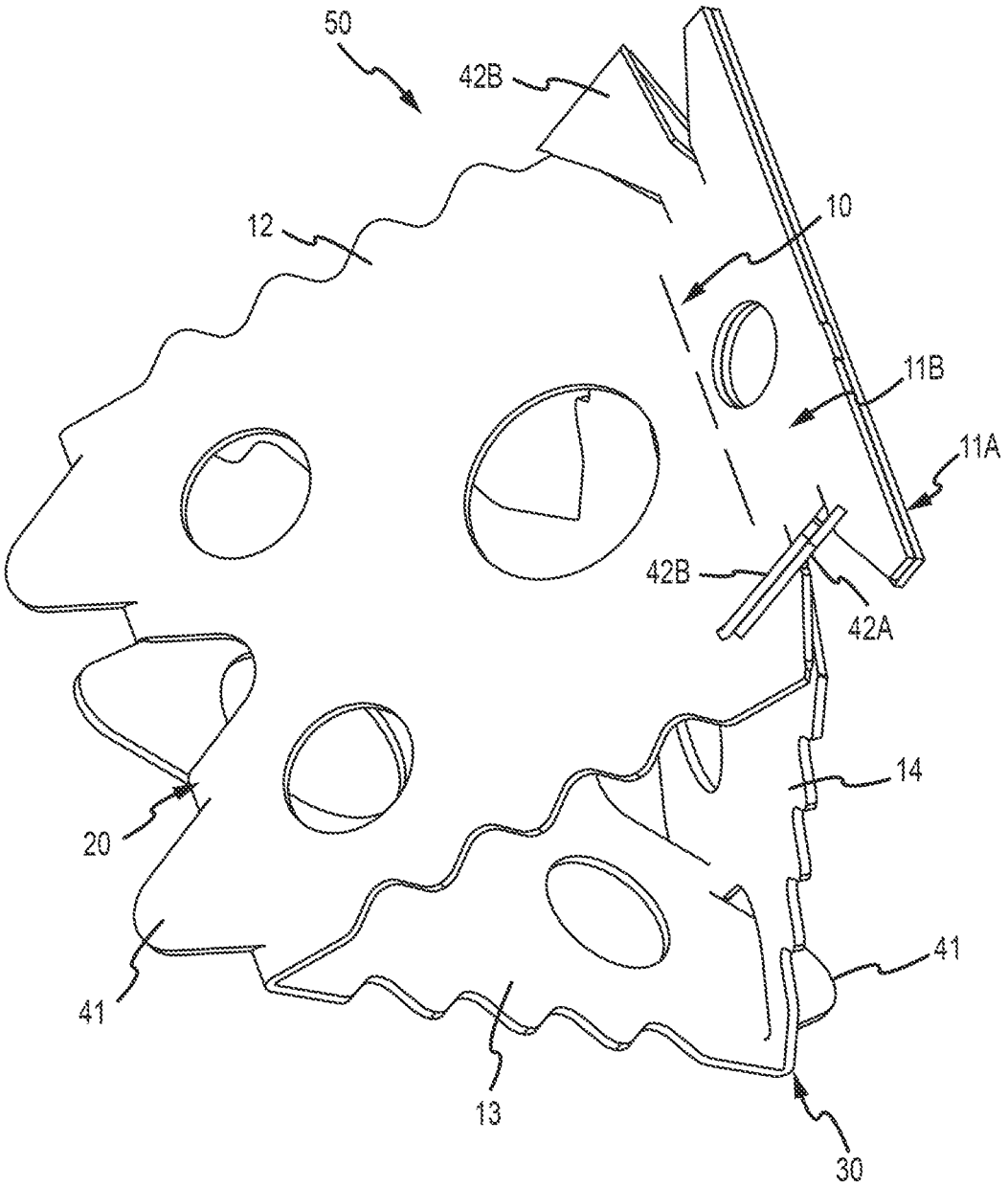
FIG. 1B depicts an expanded packing element made from the flat stock paper precursor material of FIG. 1A.

An expanded, finished packing element 50 is depicted in FIG. 1B. Dovetails 42A, 42B secure the packing element 50 into a folded configuration. Forming the individual packing elements 50 can be accomplished in various ways. The machines described herein fold the precursor chips of each row of the sheet along lines 10, 20, and 30 to form the tabs 11A and 11B, as well as sides 12, 13 and 14, into a triangular shape. The folding of lines 20 and 30 forms spines or projections 41 which are also useful for engagement and interlocking of the packing elements 50 when used in packaging.

Figure 2A:
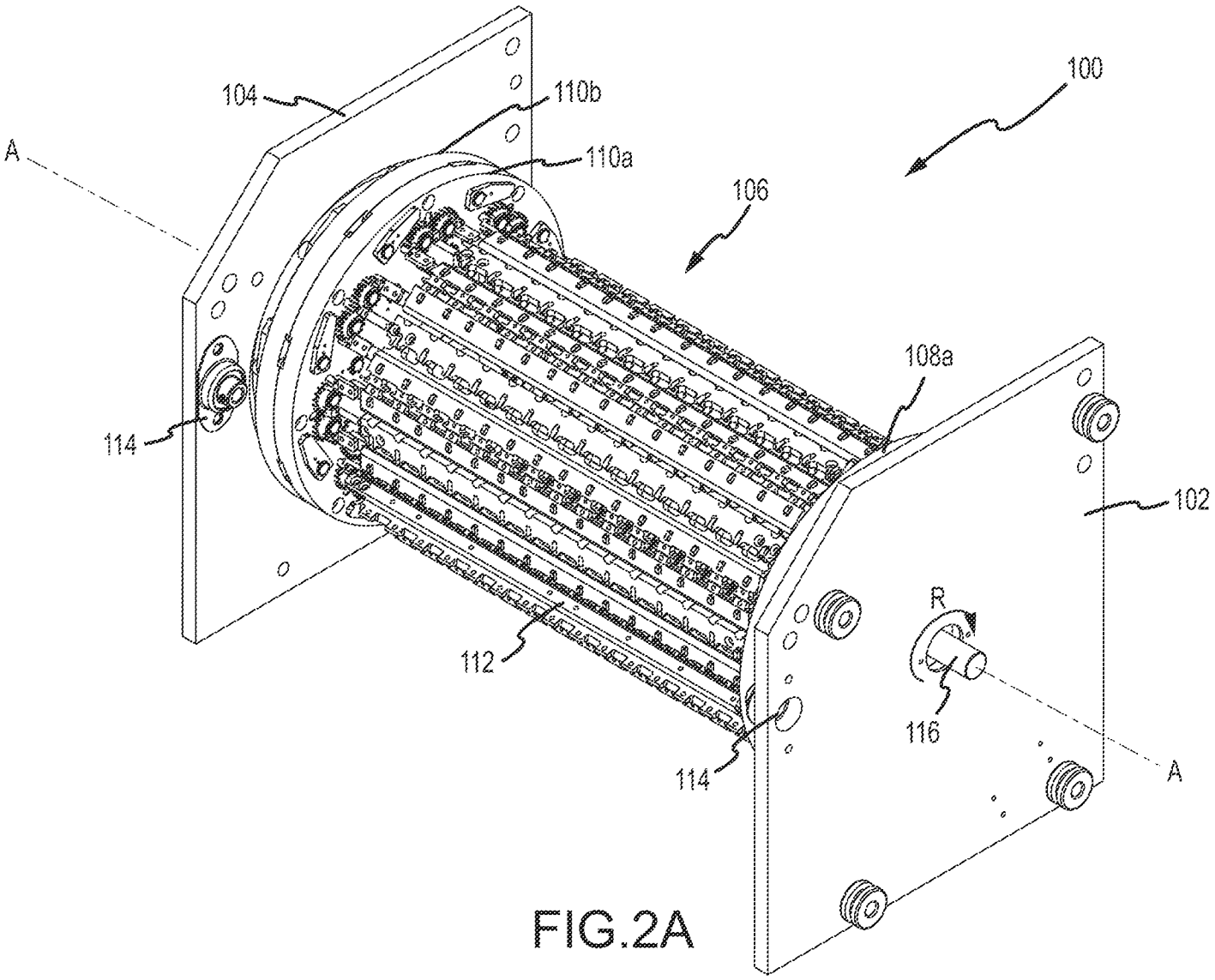
FIG. 2A depicts a front perspective view of a packing material expansion machine.

FIG. 2A depicts a perspective view of a stock material expansion machine 100. The machine, and other machines falling within the scope of the contemplated technology, can be utilized to fold-flat stock paper precursor materials, such as those described in U.S. Pat. No. 6,835,437; and U.S. Patent Application Publication Nos. 2013/0071605 and 2013/0071613, the disclosures of which are hereby incorporated by reference herein in their entireties. Since the flat-stock paper precursor materials are formed from a substantially two-dimensional flat sheet to a three-dimensional triangular packing element, the folding of the flat stock paper is referred to herein as "expanding." The thickness of the flat stock paper does not expand. More accurately, the total volume of a folded packaging element is greater than the total volume of an unfolded precursor chip.

The machine 100 includes two cam plates or base plates 102, 104 with a drum 106 disposed therebetween along an axis A. The drum 106 includes paired end plates 108, 110 at both a first end of the drum 100 and a second end of the drum 100. The end plate 108 includes an inner plate 108*a* and an outer plate 108*b*. The opposite end plate 110 includes an inner plate 110*a* and an outer plate 110*b*. The pairs of end plates 108*a*, 108*b* and 110*a*, 110*b* are closely joined together to keep residual paper material, dust, and dirt out of this portion of the drum 106. In certain examples, the plates 108*a*, 108*b*, 110*a*, 110*b* can be manufactured of a bearing material such as plastic. DELRYN™ may be used in certain examples. Additionally, between each pair of end plates 108*a*, 108*b* and 110*a*, 110*b* are supported a set of drive or master gears and a set of symmetrically driven or slave gears. These gears are depicted herein. The space between each pair of end plates 108*a*, 108*b* and 110*a*, 110*b* is set such as to allow the free and uninhibited rotation of the aforementioned gear sets. The space between the end plates 108*a*, 108*b* and 110*a*, 110*b* can be lubricated to further reduce friction at the gears. The symmetrically driven or slave gears are aligned with a number of jaws 112 that are positioned between the end plates 108, 110.

In the depicted embodiment, the drum 106 supports eight sets of jaws 112, but other numbers are contemplated, for example, four, six, ten or more sets may be utilized. In general, it is desirable that an even number of jaws are utilized, such that the forces associated therewith are balanced around the axis A of the drum 106. A larger number of jaw sets 112 may be desirable, as it makes the drum 106 more round, which helps ease loading of the flat sheet stock into the drum 106. Each jaw set 112 includes a plurality of individual jaws having a fixed base and a pair of pivotable pinchers. Each jaw of the particular jaw set 112 is configured to move in unison with the other jaws in that jaw set 112. As such, in the descriptions below, the operation of a single jaw is depicted and described. It will be apparent to a person of skill in the art, however, that all jaws in a particular jaw set operate in an identical manner described for just a single jaw. The operation of each jaw set 112 is depicted in more detail below. The pivotable pinchers include a pivotable first clamp and a pivotable second clamp disposed opposite the base from the first clamp. Each jaw set 112 closes and opens (thereby changing a separation angle between the pivotable clamps) during a rotation of the drum 112 about the axis A. This change in separation angle folds the flat sheet stock material into a plurality of expanded packing elements. The configuration of the jaws allow a central portion of the precursor chip to be held proximate the base portion while the pivotable pinchers fold the two outer portions of the precursor chip, so as to form a finished packing element. Other operations used to load, separate, bend, fold, crimp, and clear flat sheet stock into folded or expanded packing elements are performed as the drum 106 rotates about the axis A. It should be noted that all of the jaw sets 112 are not opened and closed at the same time, but are actuated at certain positions about the drum. These positions are defined, at least in part, by the captive cam groove and the positions of the followers located therein. This relationship is described below. A first or leading jaw set is oriented substantially flat (as depicted in FIG. 2A) to capture flat sheet stock on the machine 100. As that first jaw set begins rotation about the drum 106 axis A, the first and second pivotable clamps gradually pivot to a closed position about their separate and respective axes, thereby folding the flat stock material into a three-dimensional packing element. In the depicted example, the pivoting of the pivotable clamps is symmetrical. As a leading row of precursor chips is processed, that leading row is separated from a following row. Once folded, precursor chips in the same row are separated from each other, so as to form discrete packing elements. Thereafter, the flushed packing elements are removed from the first jaw as the first jaw returns to a substantially flat position. As a leading jaw set 112 advances around the drum 106, a following jaw set 112 follows, performing the same process, so as to constantly produce the three-dimensional packing elements.

The machine 100 can also include bearings 114 that are used to support a rotating brush (not shown for clarity). The rotating brush includes one or more lengths of bristles and spins as the drum 106 rotates R. In the depicted example, the rotating brush spins in an opposite direction of rotation of the drum, and the bristles come close to the drum 106. In certain examples, the brush may lightly contact the drum. The rotating brush aids in the release of any expanded packing elements that have not already dropped from the drum 106, so as to minimize and/or eliminate the possibility of interrupting the load station as the jaw set begins its second revolution about the drum 106 axis A.

The drum 106 can be driven by a motor or hand-crank (not shown) that can be connected at either end of axle 116. The rotary brush can be also be motor- or hand-driven, and in certain examples can be driven by the same mechanism as the drum 106. The drum motor can be direct-drive, belt-drive, chain-drive, and so on, so as to rotate the drum 106. DC motors can be utilized. The drive system can include a friction clutch for overload protection. A number of sensors in the system can detect rates of rotation, jams, misalignments, or any other system conditions that will enable an attached controller to determine operational status of the system. In alternative embodiments, stepper motors and stepper controls can be utilized. Certain configurations of a variable speed drive motor along with certain sensors will enable the machine to produce a pre-determined number of chips. Pulleys, gears, sprockets, and other components can be utilized to achieve a desired gear ratio and/or incorporate rotation of the brush. In certain examples, the motor can be a gear reduction motor optimized in speed and power to achieve the desired output rate. Rates of rotation for the drum 106 can be about 60 RPM, while the brush may rotate about 1750 RPM. These rates are for a maximum output in the tested configuration, even though the machine can be operated at lower rates to achieve a lesser output. The machine 100 can produce expanded paper packing elements at a rate of about 10 cubic feet/minute, with each expanded packing element measuring about 2.3 cubic inches in volume. As such, in examples where each drum 106 contains 8 jaw sets 112 and each sheet contains 15 elements per row, such a jaw set can produce about 0.16 cubic feet of packing elements with each rotation of the drum. Other performance characteristics are contemplated, depending on, e.g., the number of jaws per jaw set, the number of jaw sets per drum, the rate of drum rotation, and so on.

The machine 100 is shown bounded only by the two cam plates or base plates 102, 104. These are merely depicted as supports for the rotating drum 106. In actuality, the entire machine 100 would likely be disposed within a housing having one or more access panels, conduits for control wiring, mounting brackets for motors, etc. By surrounding the machine 100 in a housing, persons working around the machine 100 can be protected from inadvertent contact, the sound output of the machine can be reduced, and so on.

Figure 2B:
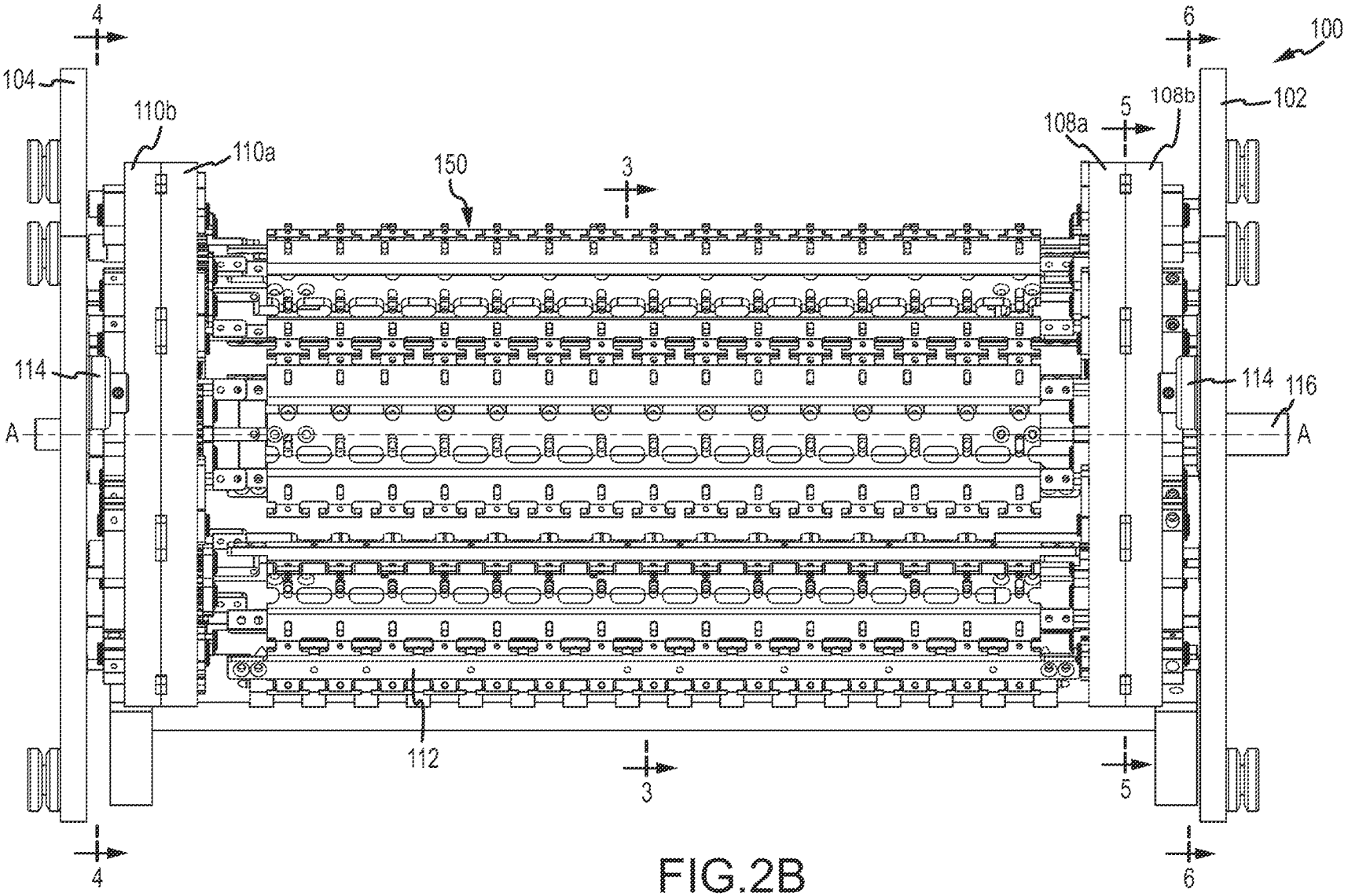
FIG. 2B is a front view of the packing material expansion machine of FIG. 1.

FIG. 2B is a front view of the packing material expansion machine 100 of FIG. 1. A number of the elements are depicted and described above in FIG. 2A and as such are not necessarily described further. The drum 106 includes a load area 150 disposed proximate an upper side of the drum 106. The load area 150 is characterized by a position of the jaw set 112 that is substantially flat and upward-facing, so as to receive a continuous sheet of flat stock material. A stage (not shown) substantially tangential to the load area 150 can be used to guide the flat stock material onto the load area 150. In FIG. 2B, the stage would be substantially orthogonal to the page. The various positions of the jaw sets 112 about the drum 106 are described in more detail below.

Figure 3:
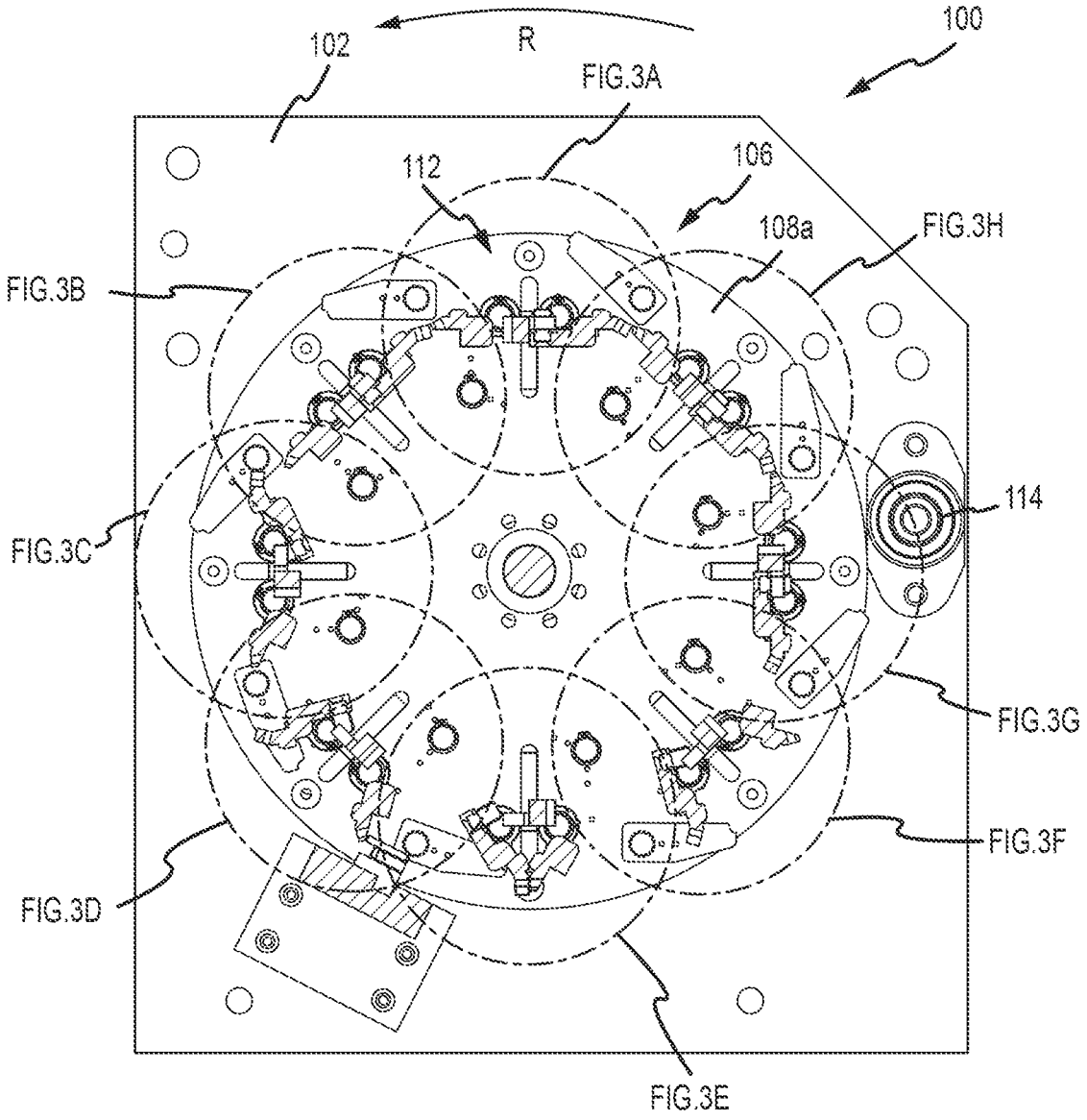
FIG. 3 depicts a jaw section view of the packing material expansion machine of FIG. 1.

FIG. 3 depicts a jaw section view of the packing material expansion machine 100 of FIG. 1. A number of elements depicted in FIG. 3 are described above and are thus not necessarily described further. The various jaw set 112 positions and general actions occurring at those positions are depicted and described in further detail below. Each of the eight jaw sets 112 pass through the depicted positions during a complete circuit of the drum 106 in a rotation direction R. These positions include, but are not limited to, a load position (depicted generally in FIG. 3A), a separate position (FIG. 3C), a fold position (FIG. 3D), a crimp position (FIG. 3E), and a clean position (FIG. 3G). Other positions are depicted. In each of the various positions, the jaw sets 112 are disposed in a particular orientation, as positioned by gears (not shown). The gears are driven by pivoting lever arms attached to follower rollers, (not shown), these follower rollers engage into a captive cam groove in the end plate or cam plate 102. Locks are also positioned as required throughout the rotation of the drum 106, and are driven by separate pivoting lever arms attached to follower rollers (shown in FIG. 4), these follower rollers engage a separate captive cam groove in the cam plate 102. The concentricity and radius of the two cam grooves is variable throughout portions of the rotation of the drum but the two grooves are specifically timed with each other to achieve the associated functionalities thereof and are described below FIGS. 3A-3H depict enlarged partial jaw section views of the packing material expansion machine 100 depicted in FIG. 3. Not every element depicted in every figure is necessarily described in conjunction with that figure. Moreover, the figures depict components at a single end of the machine. In certain examples, the gears, pivoting lever arms, cam, etc., can be disposed at a single end of the machine. However, it may be desirable to dispose these elements on both sides of the machine, so as to balance the loads generated during machine operation and ensure proper alignment of components. As such, although the following figures depict and describe components disposed at a single end of the machine, it would be understood to a person of skill in the art that similar components (in some examples mirror image components) are disposed on an opposite end of the machine and perform similarly.

Figure 3A:
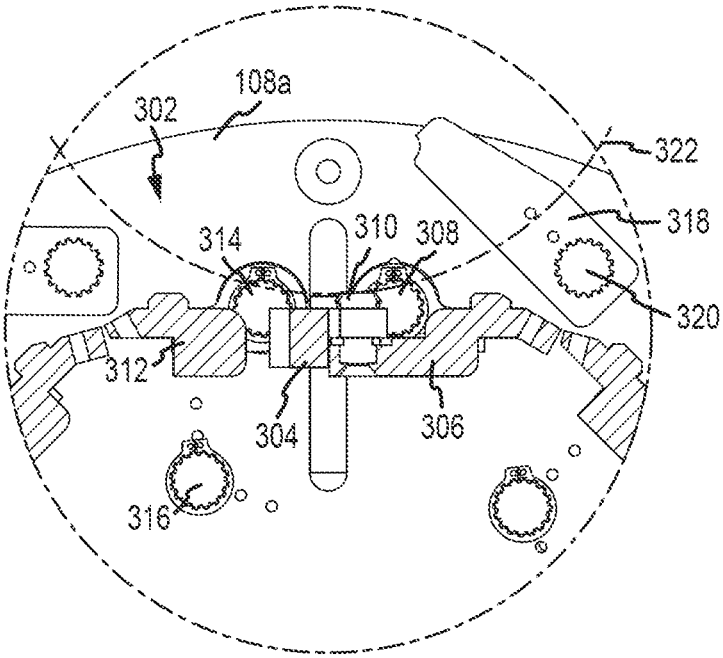
FIGS. 3A-3H depict enlarged partial jaw section views of the packing material expansion machine of FIG. 3.

FIG. 3A depicts a jaw 302 in a load position. In the load position, each jaw 302 is depicted so as to receive a sheet of flat stock material. As described above, for the depicted machine 100, each jaw set can include fifteen jaws 302. Each jaw 302 includes a fixed base portion 304 that is fixed or otherwise secured relative to the end plate 108*a*. A first pivotable clamp 306 is pivotably engaged with the end plate 108*a* at a clamp axle 308. The first pivotable clamp 306 includes a headed or toothed pin 310 that, in the load position, projects substantially orthogonally from the base portion 304. In examples, this headed pin 310 can be manufactured of hardened steel and may be replaceable. The headed pin 310 has a relief cut "shelf" that allows a sheet of flat stock material to be easily loaded onto the headed pin 310, but not easily removed. The shelf feature of the headed pin 310 is spaced to accept a variety of flat stock material thicknesses. The entire headed pin and consequently the shelf feature is also relief cut in the direction perpendicular to the drum rotation R allowing for variations in the width of the flat sheet stock. A retractable roller (depicted by dashed line 322) imparting a force orthogonal to the axis A of drum 106 forces the flat stock material over the shelf of headed pin 310. Once the flat stock material is forced over the shelf, the flat stock material is held in place against the jaw 302, independent of the retractable roller 322. A second pivotable clamp 312 is pivotably engaged with the end plate 108*a* at a clamp axle 314. The clamp axle 308 and clamp axle 314 may be keyed or toothed pins and are driven by slave gears that are described in more detail below. A master gear (described below) is connected to a master gear axle 316, which is also depicted. The master gear axle 316 is driven by a pivoting gear lever arm (described below). A lock 318 is shown in an unlocked position and is configured to rotate about a lock axle 320, as that axle 320 is rotated by a separate pivoting lock lever arm (described below).

Figure 3B:
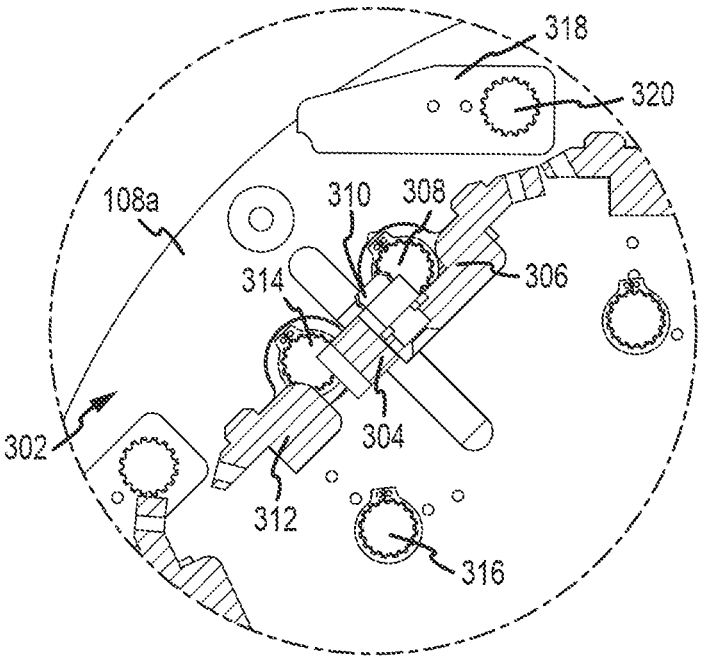
Figure 3C:
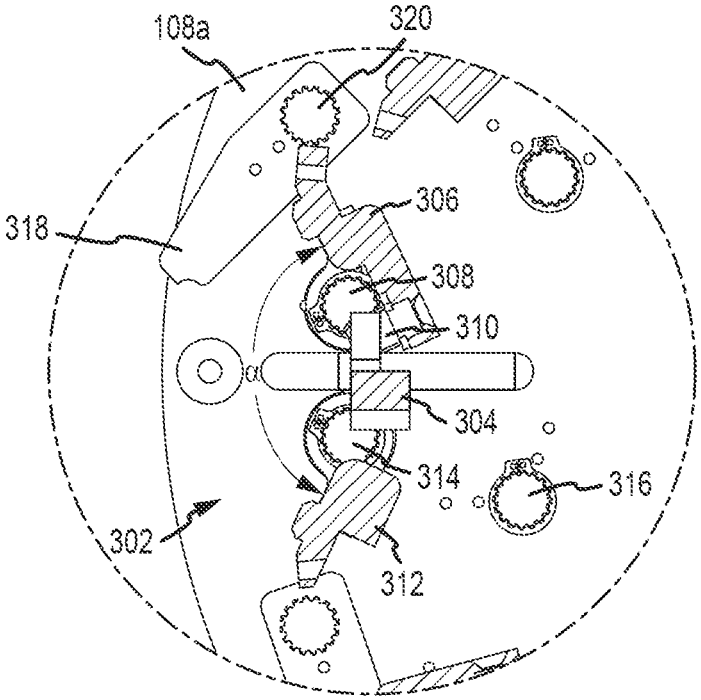

FIG. 3B depicts the jaw 302 in a drum advance position relative to the position shown in FIG. 3A, wherein the jaw 302 has advanced about the drum 106 axis A with little or no change in position of one pivotable clamp relative to the other. For example, in FIG. 3B, the first pivotable clamp 306 and second pivotable clamp 312 are still disposed parallel to the fixed base portion 304. FIG. 3C depicts the jaw 302 in a separate position. Here, the first pivotable clamp 306 and second pivotable clamp 312 have pivoted about their respective clamp axles 308, 314 so as to change a separation angle $\alpha$ therebetween. This tears the line of weakness, which may include a connecting tab that connects adjacent rows of stock material, thus enabling a leading row of stock material to be both separated from the adjacent row and subsequently folded, due to the change in separation angle $\alpha$. During pivoting of the first pivotable clamp 306 and second pivotable clamp 312, the headed pin 110 begins to retract below a material-contacting surface of the base portion 304. By retracting the headed pin 310 towards the base portion 304, the headed pin 310 exerts a pulling force on the stock material as the material is folded by the change in separation angle $\alpha$. This enables the entire row of precursor chips to be held secure to the jaw set 302 (that is, each precursor chip is held secure to its specific jaw 302 of the jaw set 112) during the beginning moments of the folding operation. Once the clamps have folded sufficiently and the headed pin 310 has passed below the base portion, the resultant radially inward force of the folding operation sufficiently holds the stock material in the jaw, without requiring the holding force imparted by the headed pin 310. This radially inward force resulting from the folding operation in conjunction with a slightly imparted downward force resulting from the headed pin 310 retraction helps ensure that the stock material is held close to the base portion 304 during folding, so as not to bulge outward and jam the machine.

Figure 3D:
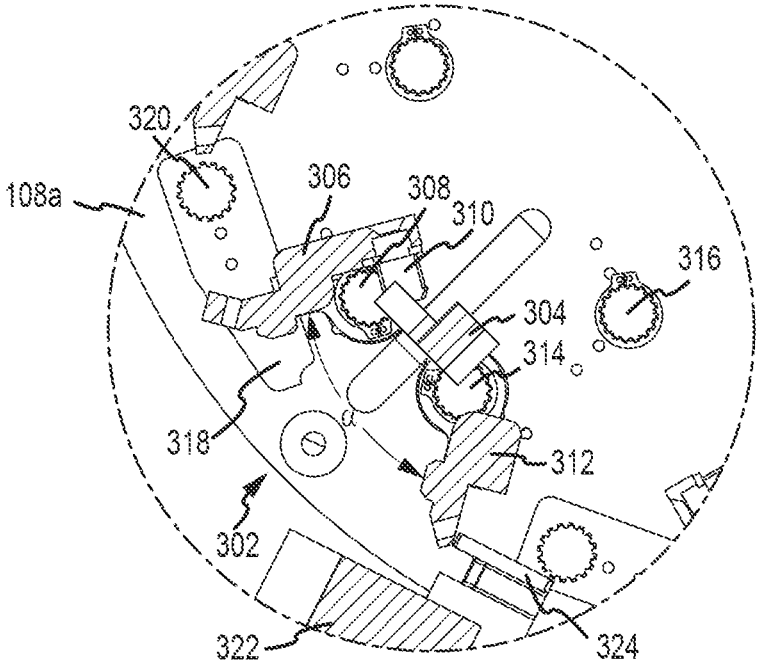

FIG. 3D depicts the jaw 302 in a partially folded position. At this position, the headed pin 310 has almost completely retracted from the base portion 304. The separation angle $\alpha$ has further decreased as the first pivotable clamp 306 and second pivotable clamp 312 approach contact with each other. Additionally, the lock 318 has begun rotation via lock axle 320 from a disengaged position towards an engaged position. As the drum rotates further, the first pivotable clamp 306 and second pivotable clamp 312 approach close contact, so as to hold opposite ends of the stock material tightly together. When the pivotable clamps 306 and 312 are in a fully folded position, the lock 318 is fully engaged with the first pivotable clamp 306. This engagement of lock 318 with the first pivotable clamp 306 relieves the rotational forces imparted by the drive gear onto the slave gears. Thus, the lock 318 becomes the structural member holding the jaw 302 (more specifically, the entire jaw set) in the folded position. In other examples, the lock 318 need not be utilized, but the forces on the drive and slave gears may be high and not necessarily desirable. This occurs prior to the jaw 302 encountering a crimper 322. The crimper 322 includes a plurality of teeth 324 (arranged in parallel like a comb). The teeth 324 penetrate the stock material between each column of stock material through similarly shaped relief passages and perform at least two functions. First, each tooth 324 bends a tab portion of the precursor chip into a tab receiving cut on that same precursor chip so as to form a lock, which holds the packing element in the folded position. Additionally, this folding movement ruptures a separate tab or connecting tabs at an interface between the columns of precursor chips for that row, so as to separate each precursor chip of stock material from an adjacent precursor chip.

Figure 3E:
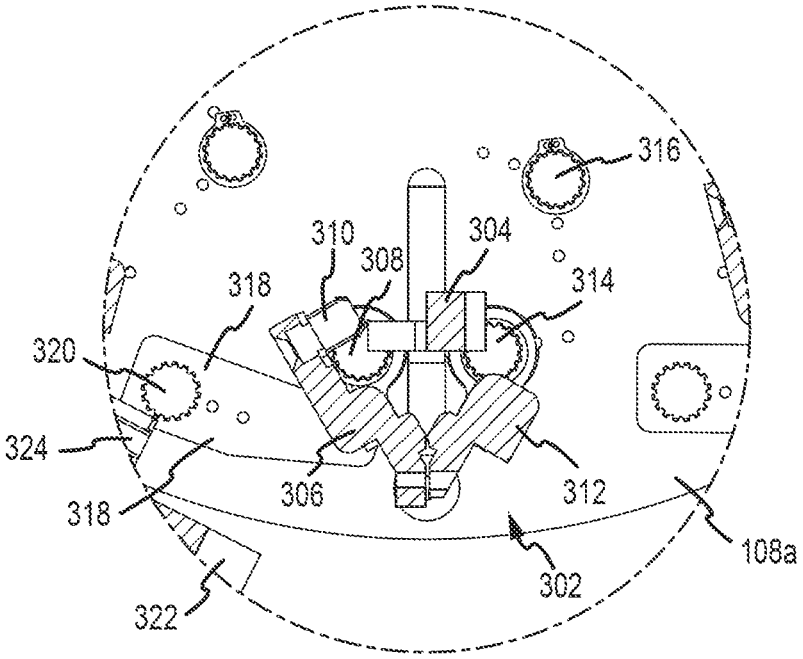
Figure 3F:
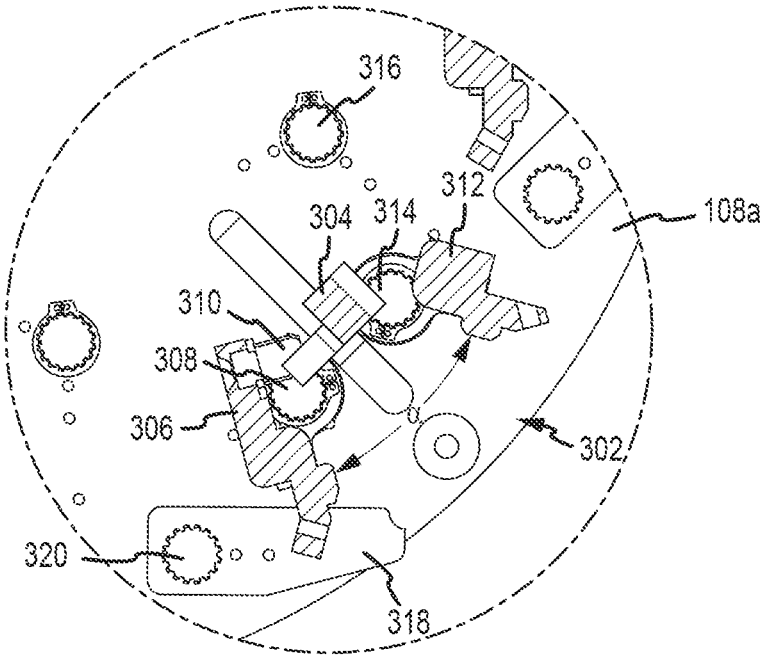
Figure 3G:
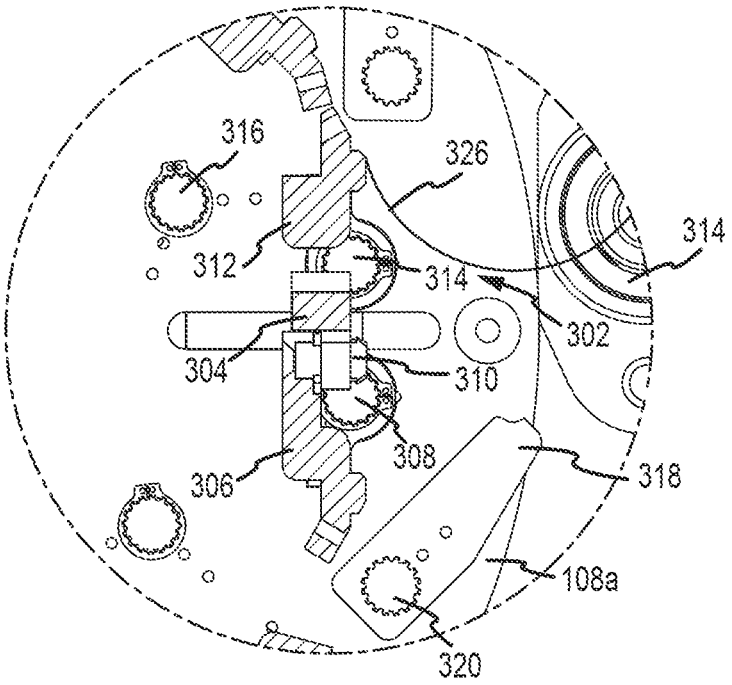
Figure 3H:
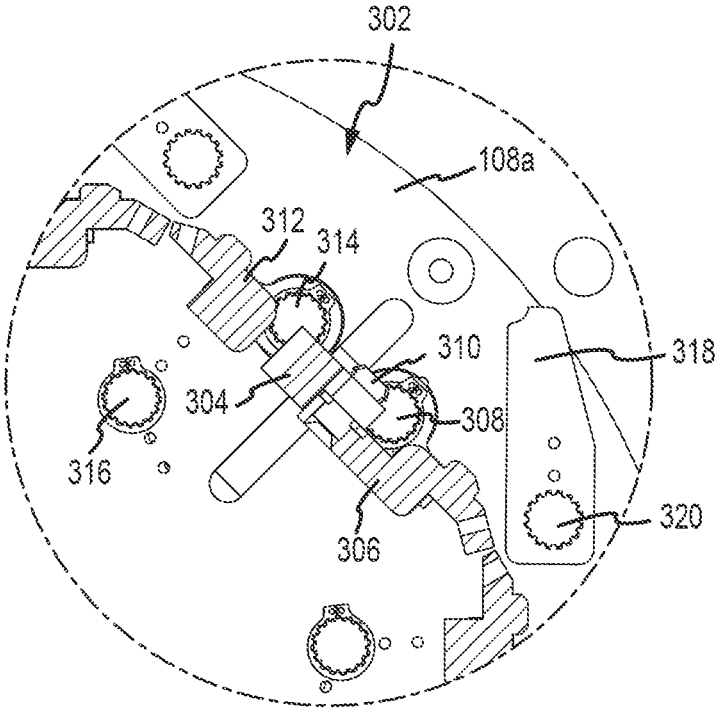

FIG. 3E depicts the jaw 302 in a crimp position, immediately after passing through the crimper 322, where each completed packing element is separated from an adjacent packing element. The process of bending tabs into their respective cuts and rupturing the connecting tabs between rows generates significant forces opposite to the direction of drum 106 rotation. The engagement of the lock 318 allows this anti-rotation force to be transferred through the lock mechanism instead of through the gear sets. As can be seen, the lock 318 is engaged with the jaw 302 (more specifically, the first pivotable clamp 306). This engagement of lock 318 is accomplished prior to crimping and disengaged fully before the jaw 302 can begin to reopen. Before the jaw 302 reopening begins, the lock 318 first pivots about lock axle 320, so as to disengage the lock 318. Once the lock 318 is disengaged, the separation angle α of the jaw 302 increases. As the jaw 302 opens, the now-folded packing element falls from the jaw 302.

FIG. 3G depicts the jaw 302 in a clean position. In the clean position, the first pivotable clamp 306 and second pivotable clamp 312 may be nearly or completely open (e.g., flat). In general, this will be sufficient to dislodge the now folded and crimped packing element from the open jaw 302. Any packing elements that may remain stuck to the jaw 302, however, will encounter a rotating brush 326 that rotates on bearings 314. Contact between the rotating brush 326 and any remaining packing elements will release the packing elements from the jaw 302. Once released, the packing elements can fall directly into a shipping box or into a hopper for later distribution. FIG. 3G depicts the jaw 302 in a drum advance or pre-load position where the jaw 302 has advanced further about the drum 106. The headed pin 310 projects from the fixed base portion 304, ready to receive a next row of stock material once the jaw 302 reaches the load position (of FIG. 3A) for reloading.

Figure 4:
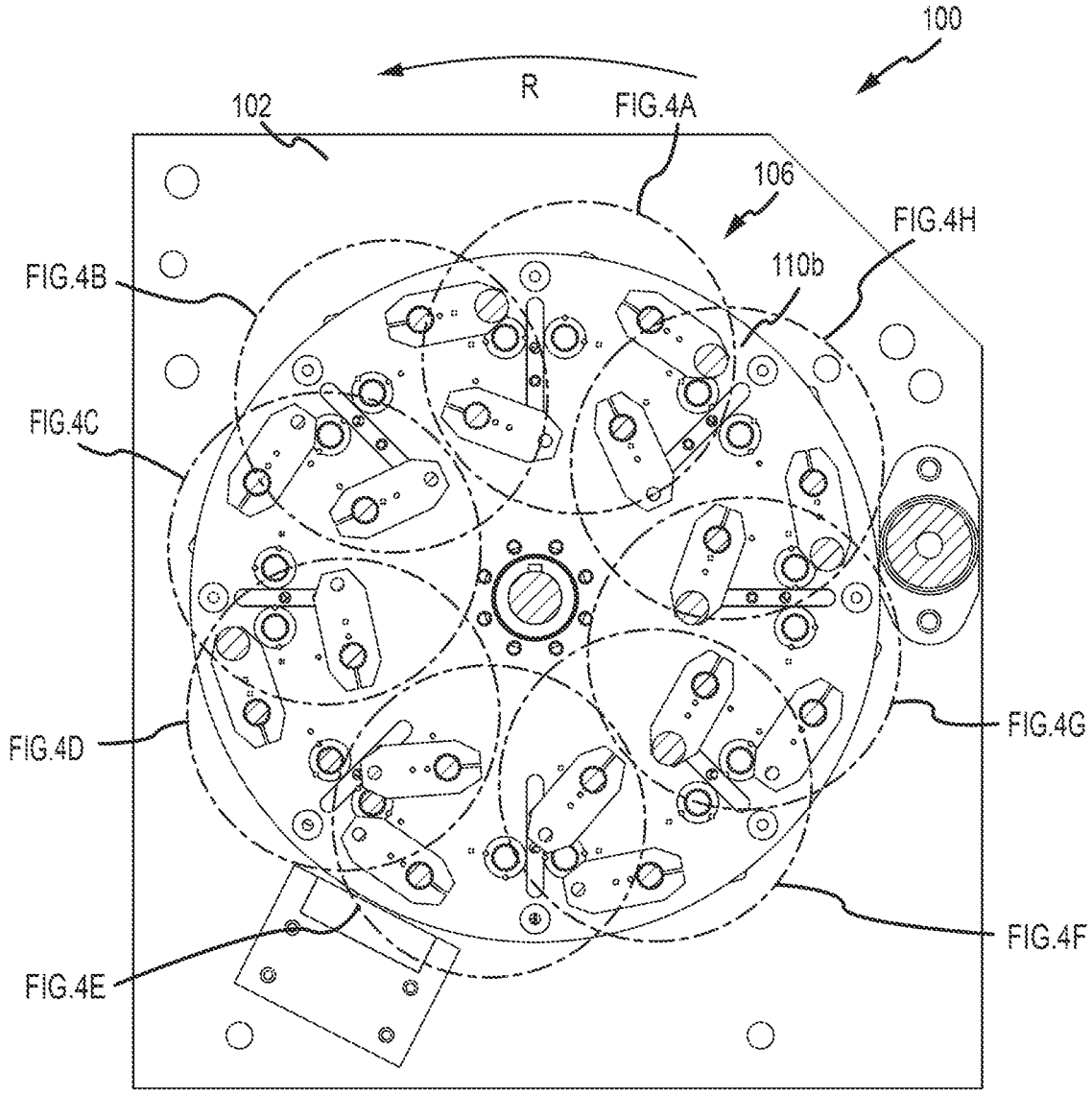
FIG. 4 depicts a pivoting lever arm section view of the packing material expansion machine of FIG. 1.
Figure 4A:
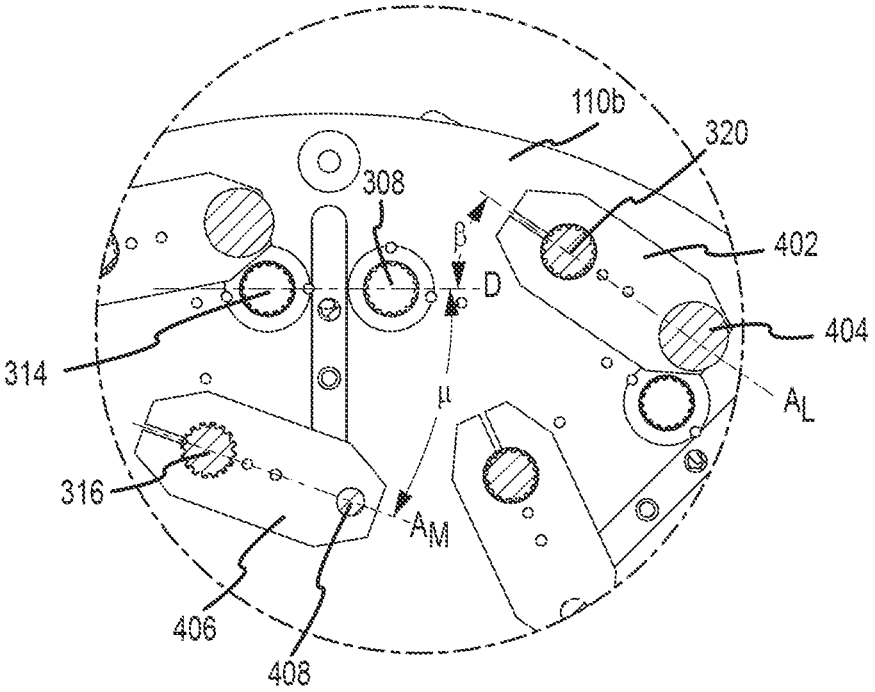
FIGS. 4A-4H depict enlarged partial pivoting lever arm section views of the packing material expansion machine of FIG. 3.
Figure 4B:
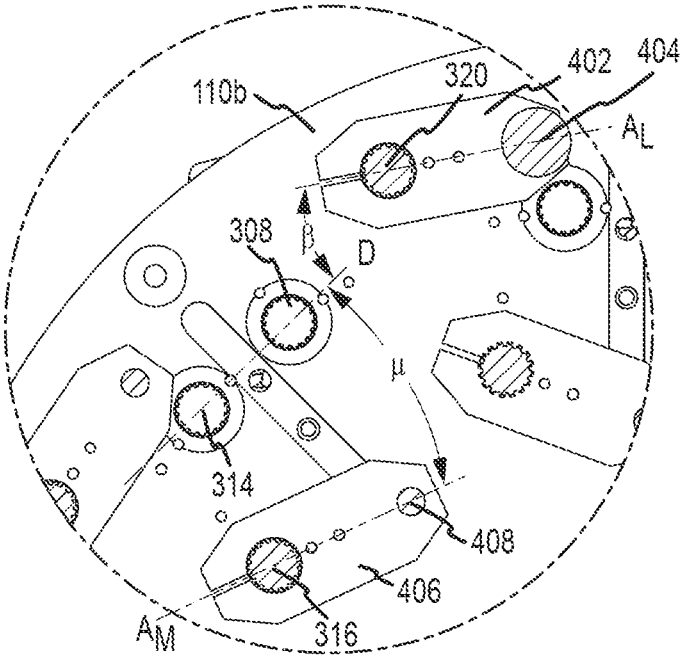
Figure 4C:
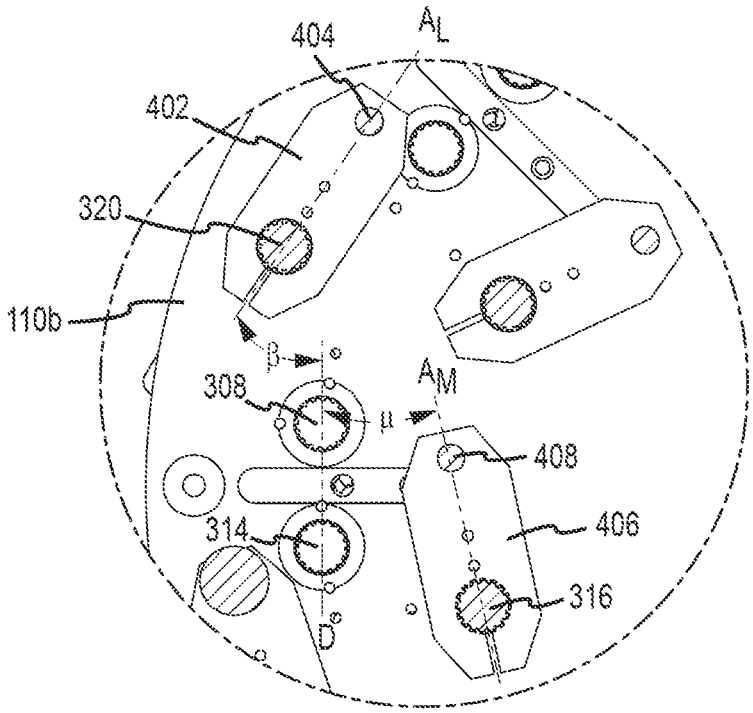
Figure 4D:
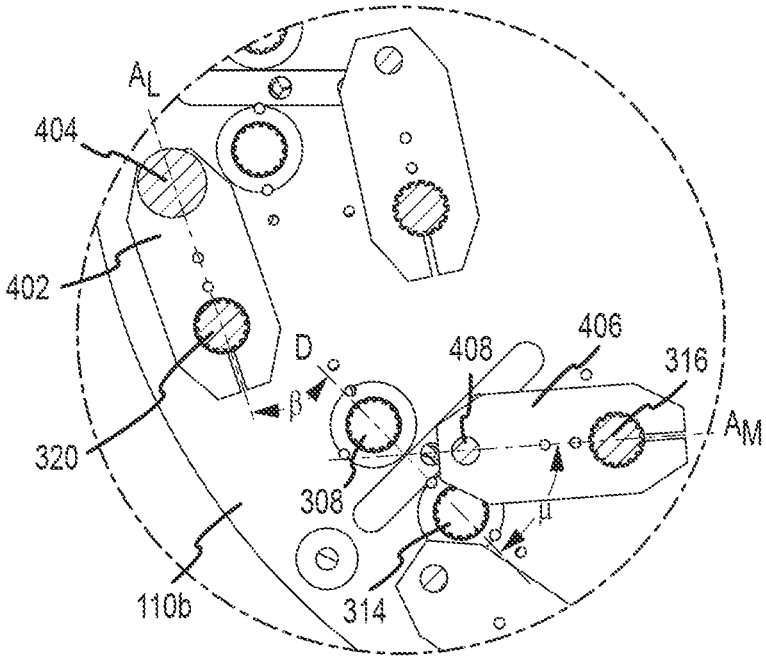

FIG. 4 depicts a pivoting lever arm section view of the packing material expansion machine 100 of FIG. 1. A number of elements depicted in FIG. 4 are described above and are thus not necessarily described further. The various jaw set positions and general actions occurring at those positions are depicted and described.

Figure 4E:
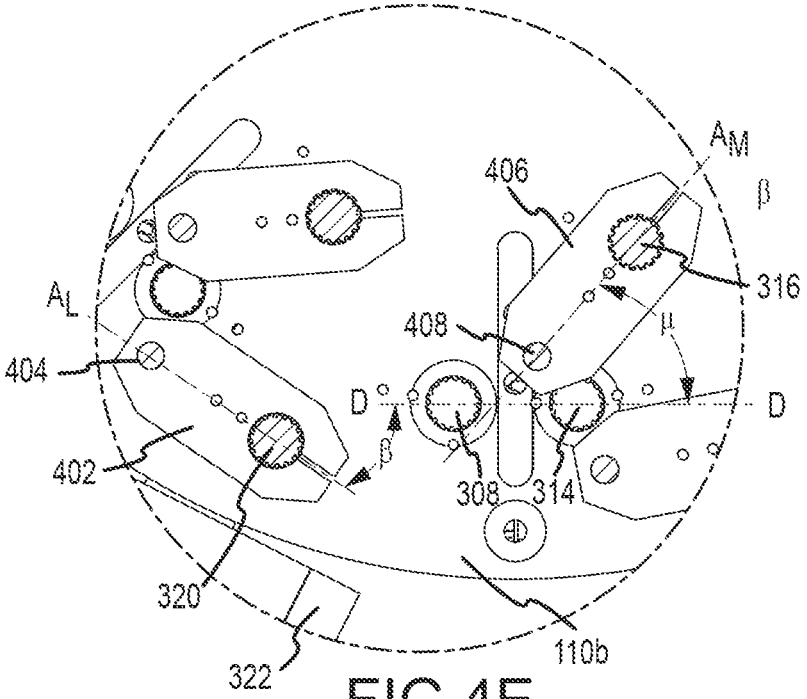
Figure 4F:
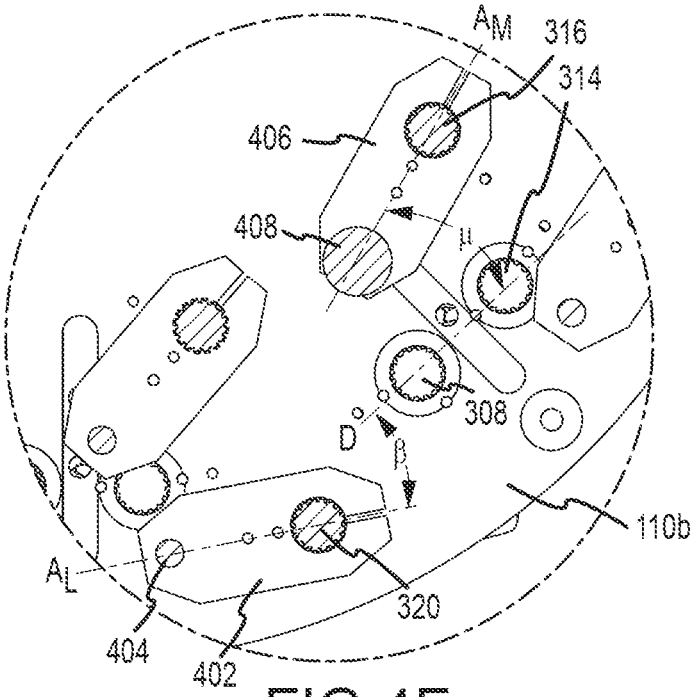
Figure 4G:
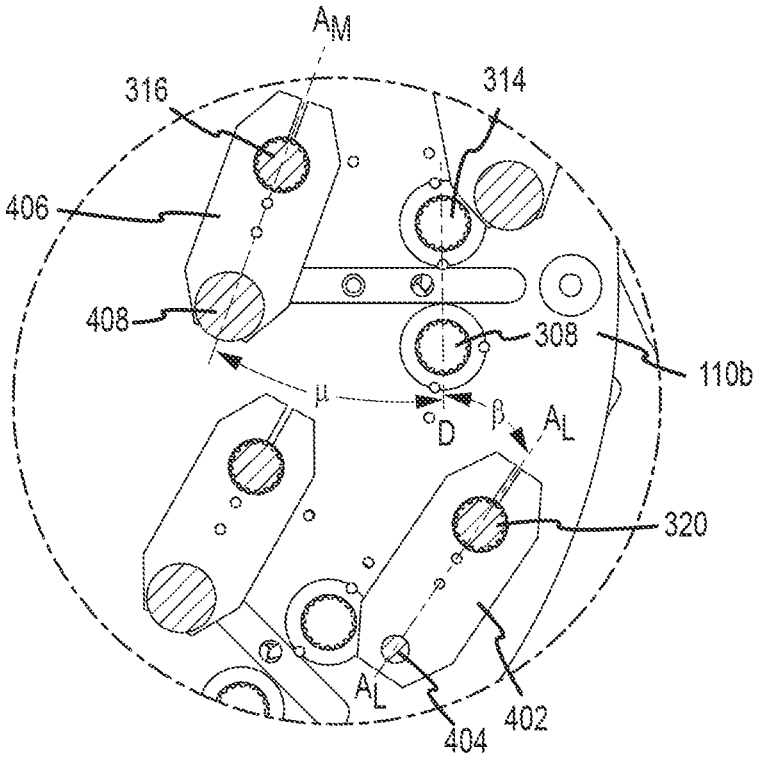
Figure 4H:
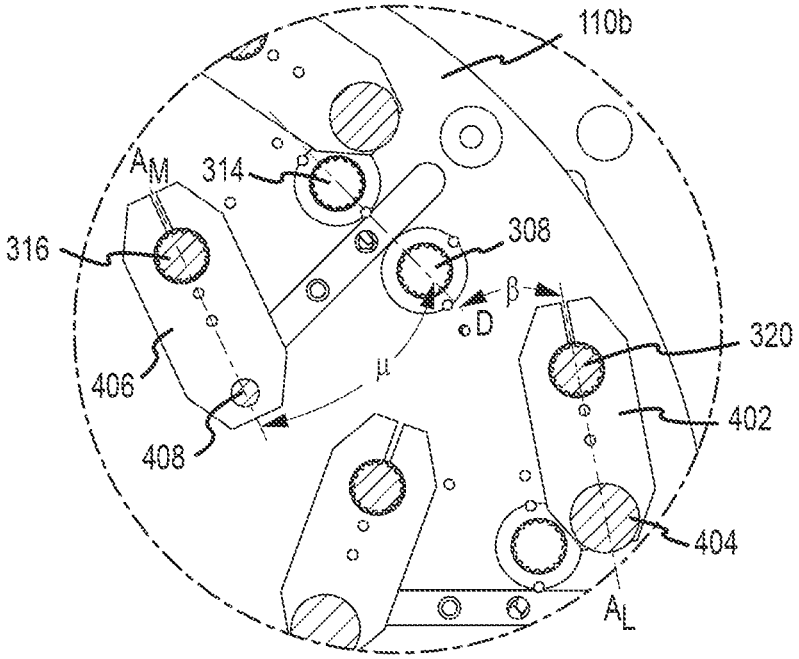

FIGS. 4A-4H depict enlarged partial pivoting lever arm section views of the packing material expansion machine 100 of FIG. 3. These views depict the components that at least partially control the position of the jaws and locks depicted in FIGS. 3A-3H. Thus, although not identical to the enlarged partial jaw section views of FIGS. 3A-3H, FIGS. 4A-4H depict the positions of the pivoting lever arms at each of the jaw positions depicted in FIGS. 3A-3H. These positions include, but are not limited to, load (depicted generally in FIG. 4A), separate (FIG. 4C), fold (FIG. 4D), crimp (FIG. 4E), and clean (FIG. 4G). Other positions are depicted herein. Not every element depicted in every figure is necessarily described in conjunction with that figure. Moreover, the figures depict components at a single end of the machine. It would be understood to a person of skill in the art that similar components are disposed on an opposite end of the machine and perform similarly. In FIGS. 4A-4H, the center points of the first clamp axle 308 and second clamp axle 314 define a datum D against which movements of the lock lever 402 and master gear lever 406 can be measured. In general, the pivoting and locking of each jaw set is controlled by two levers. An outer or lock pivoting lever arm 402 is connected to an outer or lock follower roller 404 that follows an outer or lock captive cam groove (depicted in FIG. 6). Pivotal movement of this lock lever 402 rotates the lock axle 320, which in turn, pivots the lock. An inner or master gear pivoting lever arm 406 which pivots about axle 316 is connected to an inner or master gear follower roller 408 that follows an inner or master gear captive cam groove (depicted in FIG. 6). Pivotal movement of this master gear pivoting lever arm 406 rotates the master gear axle 316, which in turn, rotates the master gear. First clamp axle 308 and second clamp axle 314 are also depicted but are not acted upon directly by any lever 402, 406 or follower roller 404, 408. Instead, the first clamp axle 308 and second clamp axle 314 are rotated based on movements of directly connected primary and secondary slave gears, respectively, which are actuated by movement of their associated master gear.

The lock lever axis $A_L$ remains at a generally consistent angle β to the datum D. This is because the lock is generally disengaged during rotation of the drum. However, in FIG. 4D, angle β begins to change as the lock begins to pivot. In FIG. 4E, the lock lever 402 has completed its full range of motion, which enables the lock to be engaged with the jaw as the jaw passes through the crimper 322. Once through the crimper 322, the angle β again changes as the lock is disengaged from the jaw, thus allowing the jaw to open. The lock fixes the jaw set in place and is disengaged before the master gear rotates to reopen the jaw. Movement of the master gear lever 406 is more noticeable in FIGS. 4A-4H. This allows the movement of the master gear lever 406 to actuate the master gear, which in turn drives the primary slave gear, which drives the secondary slave gear so as to open and close the jaws. The angle μ between the master gear lever $A_M$ and the datum D is also depicted and changes as the jaws open and close.

Figure 5:
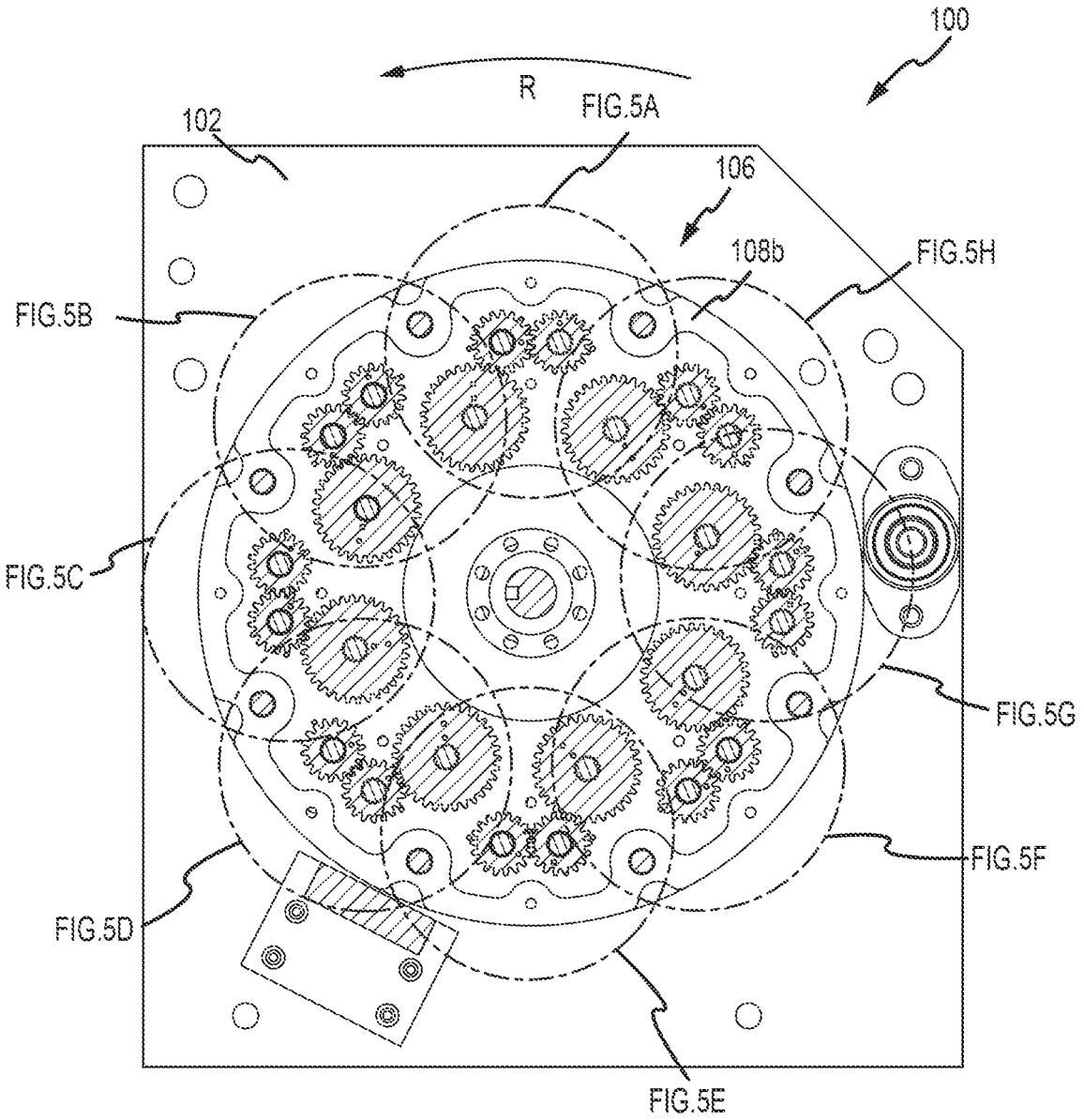
FIG. 5 depicts a gear section view of the packing material expansion machine of FIG. 1.
Figure 5A:
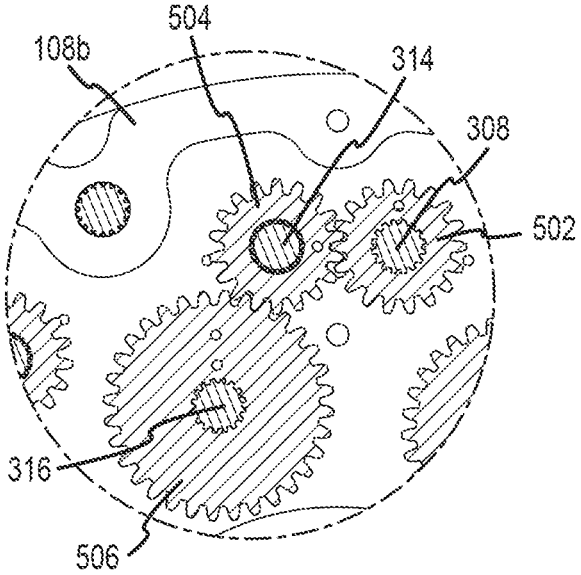
FIGS. 5A-5H depict enlarged partial gear section views of the packing material expansion machine of FIG. 3.
Figure 5B:
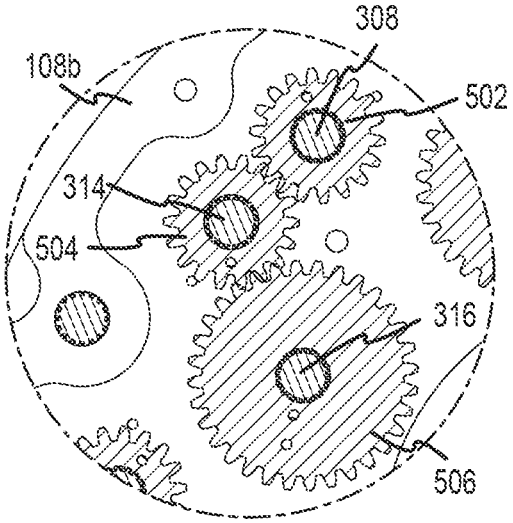
Figure 5C:
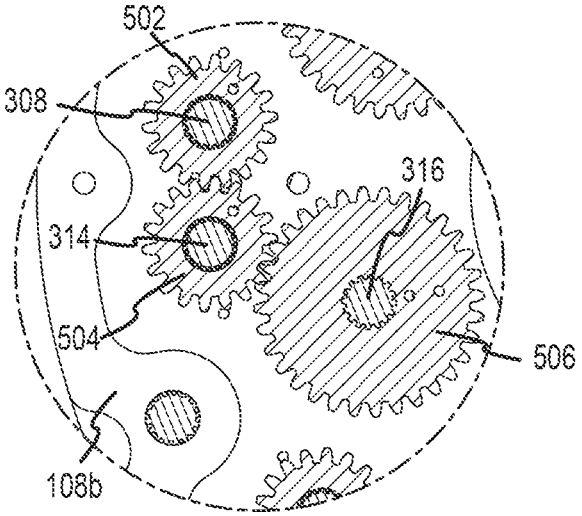
Figure 5D:
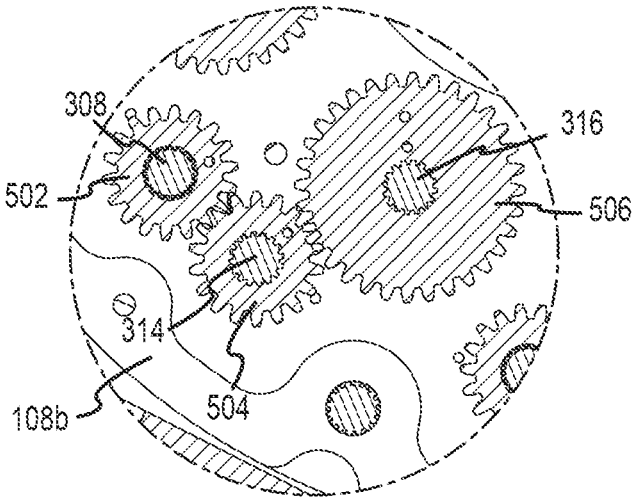
Figure 5E:
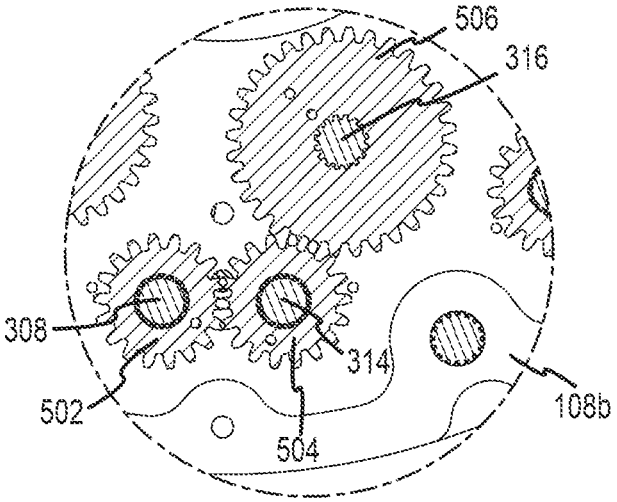
Figure 5F:
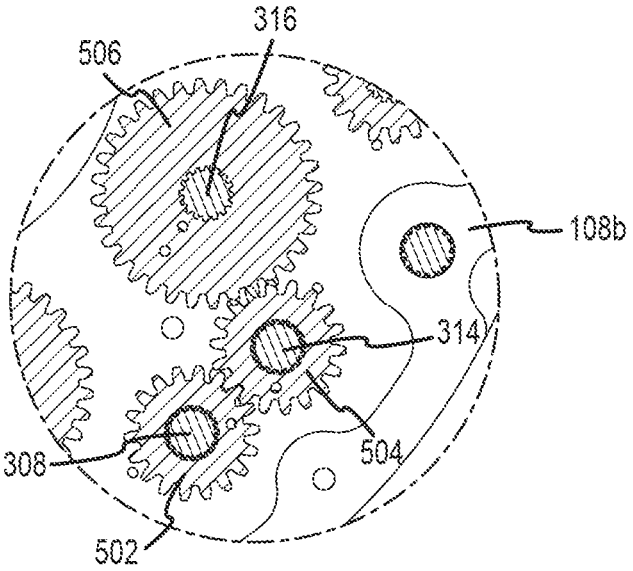

FIG. 5 depicts a gear section view of the packing material expansion machine 100 of FIG. 1. A number of elements depicted in FIG. 5 are described above and are thus not necessarily described further. The various jaw set positions and general actions occurring at those positions are depicted and described.

Figure 5G:
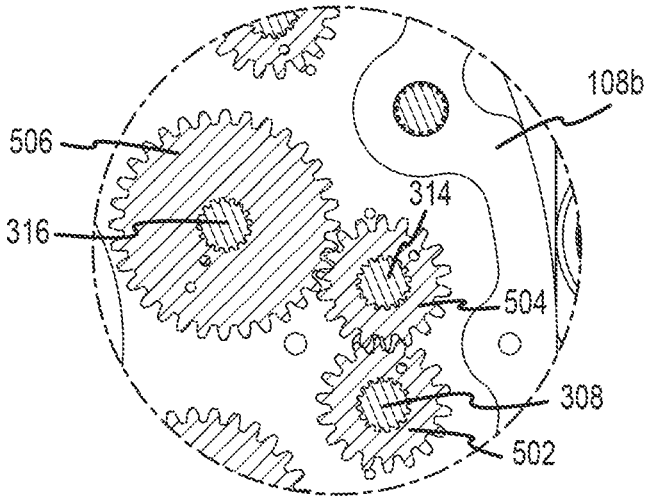
Figure 5H:
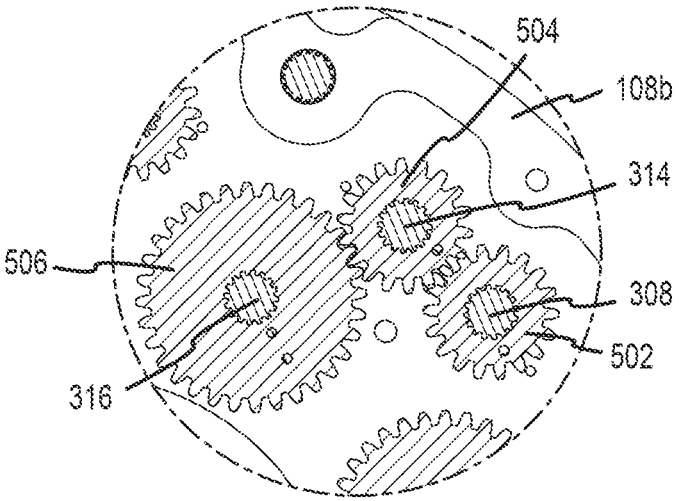

FIGS. 5A-5H depict enlarged partial gear section views of the packing material expansion machine 100 of FIG. 3. These views depict the components that at least partially control the position of the jaws depicted in FIGS. 3A-3H. These positions include, but are not limited to, load (depicted generally in FIG. 5A), separate (FIG. 5C), fold (FIG. 5D), crimp (FIG. 5E), and clean (FIG. 5G). Other positions are depicted herein. Not every element depicted in every figure is necessarily described in conjunction with that figure. Moreover, again the figures depict components at a single end of the machine. It would be understood to a person of skill in the art that similar components are disposed on an opposite end of the machine and perform similarly. In general, each jaw set is operated by two slave gears. More specifically, the first clamp is driven by a secondary slave gear 502 that turns first clamp axle 308. The second clamp is driven by a primary slave gear 504 that turns second clamp axle 314. A master gear 506 is driven by master gear axle 316, which is in turn driven by master gear pivoting lever arm. As the drum rotates, movement of the master gear pivoting lever arm corresponding to movement of the master gear follower roller rotates the master gear 506. The gear ratio between the master gear and the slave gears is such that the movement of the master gear follower in its captive cam groove provides the rotation to the slave gears required for a complete pivoting of the pivotable jaws.

Figure 6:
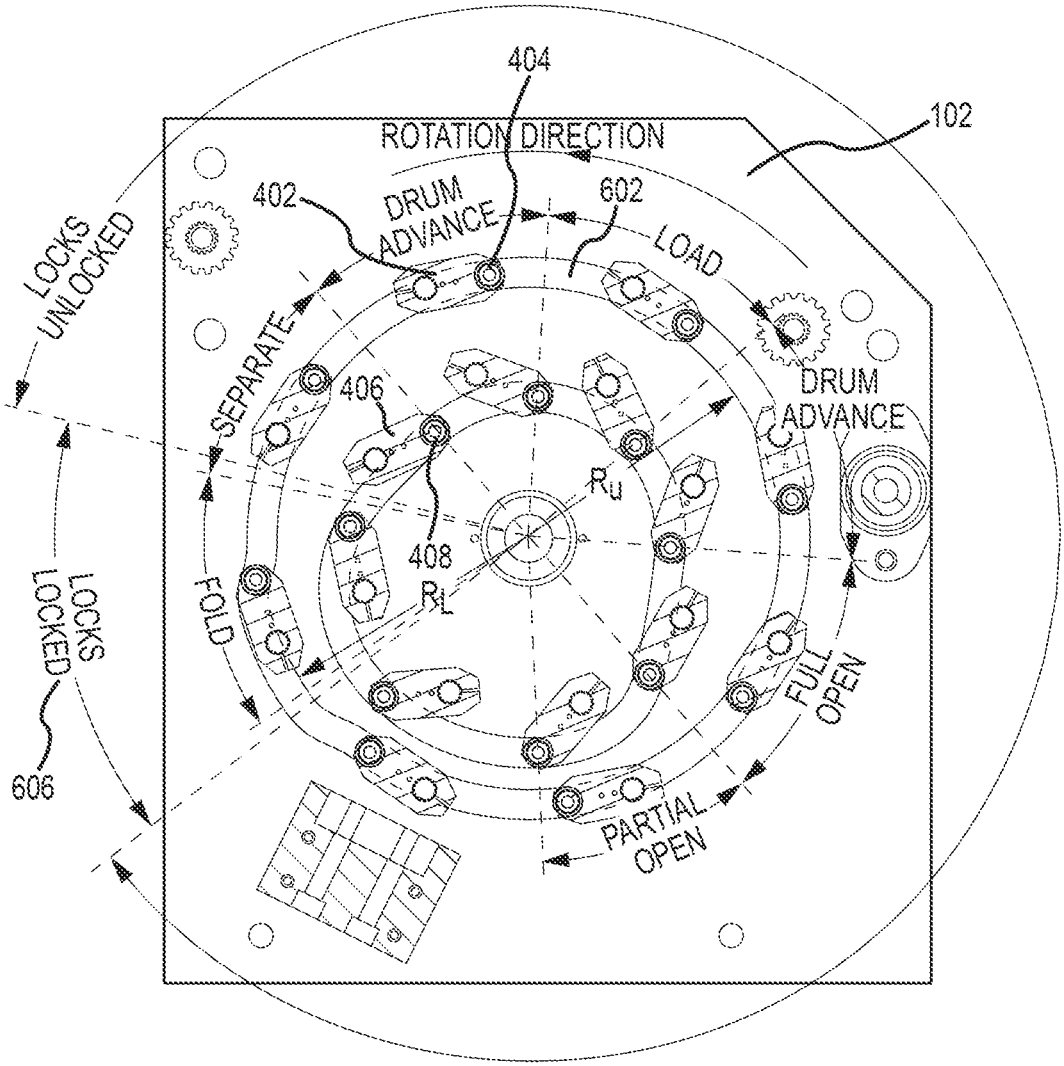
FIG. 6 depicts a cam plate section view of the packing material expansion machine of FIG. 1.

FIG. 6 depicts a cam plate section view of the packing material expansion machine 100 of FIG. 1. The cam plate 102 includes an outer captive cam groove 602 and an inner captive cam groove 604. The outer captive cam groove 602 guides movement of the outer or lock follower roller 404. A general position of the lock lever 402 as the lock follower roller 404 moves within the groove 602 is also depicted for clarity. As such, the outer captive cam groove defines a relative constant unlock radius $R_U$ that positions the lock associated therewith in an open or unlocked position. As depicted in FIG. 3, the locks are unlocked for a majority of the drum rotation. Lock area 606, however, depicts the change in radius to lock radius $R_L$ that positions the lock in a locked position. Since the lock follower roller 404 trails the jaws, relative to the direction of rotation, the lock follower roller 404 remains in this portion of the outer captive cam groove 602 defined by lock radius $R_L$ as the jaws pass through the crimper 322. Once the jaws have cleared the crimper 322, the lock follower roller returns to the unlock radius $R_U$ and the lock is disengaged so the jaws can reopen.

The inner or master gear cam 604 guides movement of the inner or master gear follower roller 408. A general position of the master gear lever 406 as the master gear follower roller 408 moves within the groove 604 is also depicted for clarity. In certain examples, the master gear follower roller 408 may trail the jaws by about 20-30 degrees. This is why e.g., the load position depicted in FIG. 6 trails the flat load position of the jaws as depicted in FIG. 3. The inner captive cam groove 604 defines a plurality of radii, as the jaws rotate about the drum and open and close as required for the various positions. FIG. 6 depicts these positions and the general curvature of the inner captive cam groove 604. The boundaries between the various positions are generally depicted and do not necessarily define exact positions of the jaw at any point of rotation of the drums.

Figure 7:
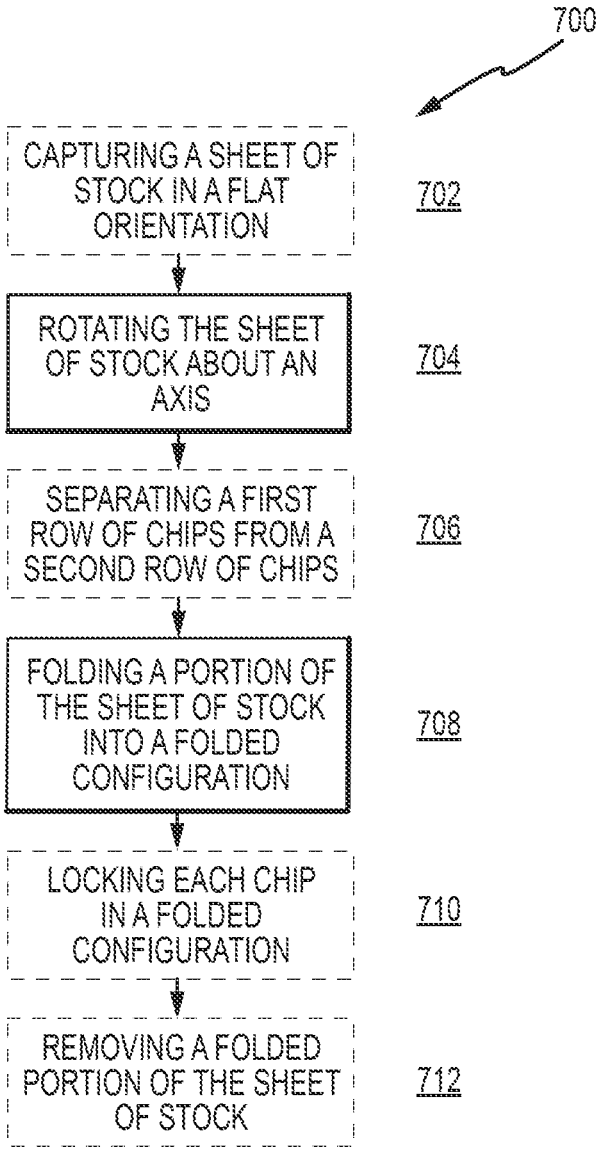
FIG. 7 depicts a method of expanding flat stock material into expanded packing material.

FIG. 7 depicts a method 700 of expanding flat stock material into packing elements. In the broadest sense, the method 700 contemplates rotating a sheet of stock about an axis, operation 704, while simultaneously folding the sheet of stock from a substantially flat configuration to a substantially folded configuration, operation 708. Additional steps of the method 700 are depicted. As described elsewhere herein, the various operations of the method 700 occur while a drum onto which the flat stock material is loaded rotates about an axis. This rotation allows for fast, efficient folding of packing elements on-demand. The method begins in operation 702 by capturing a sheet of stock material in a substantially flat configuration. The stock is captured after being loaded onto a rotary machine. The term "capture" in this context contemplates being held by one or more jaws such that the stock material can be advanced via rotation about the drum, as indicated in operation 704. Thereafter, in operation 706, a first or leading row of precursor chips is separated from a second or following row of precursor chips. Once separated, operation 708 folds the separated portion of the sheet of stock into a folded configuration. In operation 710, each folded precursor chip is locked into a folded configuration. This locking forms the finished packing element. Thereafter, in operation 712, the folded packing elements are removed from the machine.

As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents that may otherwise be afforded a particular value. Further, unless otherwise stated, the term "about" shall expressly include "exactly," consistent with the discussions regarding ranges and numerical data. Lengths, sizes, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. This same principle applies to ranges reciting only one numerical value. Furthermore, such an interpretation should apply regardless of the breadth of the range or the characteristics being described.

Notwithstanding that the numerical ranges and parameters setting forth the broad scope of the technology are approximations, the numerical values set forth in the specific examples are reported as precisely as possible. Any numerical value, however, inherently contain certain errors necessarily resulting from the standard deviation found in their respective testing measurements.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured all such modifications as fall within the spirit and scope of the technology. Accordingly, what is desired to be secured by Letters Patent is the technology as defined and differentiated herein, and all equivalents.

What is claimed is:

1. A system comprising:

a base;

an end plate rotatably engaged with the base, wherein the end plate is adapted to rotate about an axis substantially orthogonal to the base;

a first jaw set extending from the end plate, wherein the first jaw comprises:

a base portion fixed to the end plate;

a first pivotable clamp pivotably engaged with the end plate, wherein the first pivotable clamp comprises a plurality of first individual jaws; and a second pivotable clamp pivotably engaged with the end plate, wherein the second pivotable clamp comprises a plurality of second individual jaws, wherein as the end plate rotates about the axis, the first pivotable clamp and the second pivotable clamp define a first separation angle when the end plate is at a first position and a second separation angle when the end plate is at a second position; and a crimper fixed to the base and comprising a plurality of teeth disposed on the base to penetrate between adjacent pairs of the plurality of first individual jaws and between adjacent pairs of the plurality of second individual jaws as the end plate rotates about the axis.

2. The system of claim 1, further comprising a second jaw disposed opposite the axis from the first jaw.

3. The system of claim 1, wherein the base defines a cam, and wherein the system further comprises:

a follower disposed in a groove cam; and a lever connected to the follower, wherein movement of the lever changes a separation angle of the first pivotable clamp and the second pivotable clamp.

4. The system of claim 3, further comprising:

a master gear engaged with the lever;

at least one slave gear rotatably engaged with the master gear, wherein the at least one slave gear is engaged with at least a portion of the first pivotable clamp, such that a rotation of the master gear pivots the at least one portion of the first pivotable clamp.

5. The system of claim 1, wherein the first pivotable clamp comprises a pin, and wherein when the first pivotable clamp and the second pivotable clamp is at the first separation angle, the pin extends above a surface of the base portion, and wherein when the first pivotable clamp and the second pivotable clamp is at the second separation angle, the pin is retracted below the surface of the base portion.

6. A material folding system comprising:

a base;

an end plate rotatable relative to the base;

a leading jaw including:

a leading base portion fixed to the end plate; and a leading pair of clamps, wherein each of the leading pair of clamps are pivotably engaged with the end plate and comprise a plurality of individual jaws; and a crimper fixed to the base and comprising a plurality of teeth oriented to penetrate between adjacent pairs of the plurality of individual jaws as the end plate rotates about the axis.

7. The system of claim 6, wherein the leading jaw comprises a plurality of substantially parallel leading jaws, wherein each leading pair of clamps of the substantially parallel leading jaws are configured to pivot simultaneously.

8. The system of claim 7, further comprising a following jaw parallel to the leading jaw, wherein the following jaw includes:

a following base portion fixed to the end plate; and a following pair of clamps, wherein each of the following pair of clamps are pivotably engaged with the end plate.

9. The system of claim 8, wherein the following pair of clamps of the following jaw pivot about axes substantially parallel to axes defined by each of the leading pair of clamps of the leading jaw.

10. The system of claim 8, wherein the end plate is a rotating plate having an axis of rotation and wherein the leading jaw and the following jaw are disposed on opposite sides of the axis of rotation.

* * * * *